10/15/85 XF 4,546,542

United States Patent [19]

Proud

[11] Patent Number: 4,546,542

[45] Date of Patent: Oct. 15, 1985

[54] METHOD AND APPARATUS FOR MAKING FORK CONTACTS

[75] Inventor: Ralph A. Proud, Willoughby Hills, Ohio

[73] Assignee: Symbex Corporation, Painesville, Ohio

[21] Appl. No.: 309,568

[22] Filed: Oct. 8, 1981

[51] Int. Cl.[4] ..... H01R 43/00

[52] U.S. Cl. ..... 29/874; 29/564.6; 29/882

[58] Field of Search ..... 29/882, 874, 884, 885, 29/564.1, 564.6; 339/99 R, 99 P, 259 R; 72/386, 339, 337, 379, 384, 404, 472

[56] References Cited

U.S. PATENT DOCUMENTS

| | | | |
|---|---|---|---|
| 2,539,230 | 1/1951 | Craig | 173/363 |
| 3,086,251 | 4/1963 | Bernat | 18/59 |
| 3,289,148 | 11/1966 | Antes | 339/176 |
| 3,299,493 | 1/1967 | Gehrt et al. | 29/882 X |
| 3,503,036 | 3/1970 | Desso et al. | 339/258 |
| 3,559,604 | 2/1971 | Ruehleman | 29/874 |
| 3,605,078 | 9/1971 | Paullus | 339/259 R |
| 3,646,499 | 2/1972 | De Land et al. | 339/60 M |
| 3,675,320 | 7/1972 | Watanabe | 29/874 |
| 3,685,006 | 8/1972 | Jerrold-Jones | 339/177 R |
| 3,707,932 | 1/1973 | Murray | 113/119 |
| 3,728,981 | 4/1973 | Paullus | 29/882 |
| 3,914,972 | 10/1975 | Gillette et al. | 72/386 X |
| 4,025,143 | 5/1977 | Rozmus . | |
| 4,045,868 | 9/1977 | Ammon et al. | 29/882 X |

FOREIGN PATENT DOCUMENTS

| | | | |
|---|---|---|---|
| 209601 | 1/1957 | Australia | 29/882 |
| 683981 | 4/1964 | Canada . | |
| 2620757 | 11/1977 | Fed. Rep. of Germany | 29/882 |
| 1077495 | 4/1966 | United Kingdom . | |
| 1209187 | 10/1967 | United Kingdom . | |
| 1261012 | 1/1972 | United Kingdom | 29/882 |
| 1398164 | 6/1975 | United Kingdom | 29/882 |

*Primary Examiner*—Howard N. Goldberg
*Assistant Examiner*—Carl J. Arbes
*Attorney, Agent, or Firm*—Maky, Renner, Otto & Boisselle

[57] ABSTRACT

A method of making a planar fork contact initially having plural tines with respective coplanar surfaces and gold inlay material integral with such coplanar surfaces, to bring them into substantially confronting relation with each other within the plane of the contact. Other steps include setting the twist to maintain such inlay containing areas in such confronting relation, controlling such twisting and the location of the respective twists for contact uniformity, and using cut-away tabs on the tines to facilitate twisting. The invention also relates to an apparatus for making such planar fork contacts, especially by utilizing the method of the invention.

21 Claims, 14 Drawing Figures

METHOD AND APPARATUS FOR MAKING FORK CONTACTS

TECHNICAL FIELD

The present invention relates generally, as indicated, to method and apparatus for making fork contacts, and, more particularly, to such method and apparatus that enable making planar fork contacts that have contacting material, such as gold inlay material or the like, in the respective tines thereof.

BACKGROUND OF PRIOR ART

Planar electrical contacts of the fork type are well known as are connectors that use such contacts. A typical prior fork contact is shown in U.S. Pat. No. 4,030,799. Such fork contact has a pair of tines that extend out from a base. A member, such as a pin contact, may be inserted between a pair of tines to make an electrical connection therewith. Such patent also discloses an electrical connector using such contacts. The connector is of the cable termination assembly type, which includes the contacts, a housing, and at least a portion of a multiconductor cable. The present invention may be used with such cable termination assemblies and with other types of electrical connectors, such as a cable termination, which is like the noted assembly but without necessarily including the cable as a part thereof.

It is well known that such fork contacts may be formed by die cutting or die stamping the same from a relatively thin sheet of metal material. However, such stamping often leaves the finished product with a smooth side, which is the one that the cutting die strikes first, and a burr side or surface. The sharp, rough burrs at such burr side usually are undesirable because they can damage pin contacts inserted to engagement therewith, for example by scoring off high conductivity coatings or the like applied to such pin contacts. It would be desirable to permit such die cutting of fork contacts while eliminating with facility such scoring and like problems created by such burrs.

To improve the electrical conductivity and possibly for other reasons electrical contacts often are plated with certain materials, such as high conductivity materials. For example, a contact formed of nickel silver may be plated with gold or palladium silver in order substantially to improve the electrical conductivity thereof, especially at the surface area of the contact where it engages with or wipes against a pin contact or other member inserted to engage the same. Plating materials, though, sometimes are applied non-uniformly, which may result in uneven wear; and there may be voids in the plating allowing undesirable oxidation to occur. Also, plating is unnecessarily relatively expensive because the entire contact usually is plated, which wastes plating material at portions of the contact that do not perform a contacting function.

The use of relatively highly conductive or high conductivity inlay material has eliminated the need for plating an entire electrical contact, but contacts using inlay material usually are non-planar and relatively large in comparison to the required dimensions of a planar fork contact or the like. An advantage of inlay material over plating is the former would be denser and more uniform in thickness than the latter. Also, the inlay material usually would present a contacting surface area for engaging an inserted member, e.g. a pin contact, that is smoother and, therefore, a better contacting surface, than the plated or unplated surface, say of a conventional fork contact. The usual technique for applying inlay material to sheet material has been to force by pressure, e.g. by a rolling process, a strip of inlay material into a shallow groove in the sheet material from which the contact would be cut. Then, the contact would have to be deformed, for example in the shape of a hairpin curve or in the form of a full or three quarters folded box that has contact arms extending, say upwardly, from respective opposite sides of the box and parallel thereto, in order to locate the inlay material at a position of contacting exposure to a pin contact inserted to engagement therewith.

In contrast, though, a planar fork contact is a secure, integral device that requires minimum space while assuring a highly effective contacting/wiping function to establish a connection with, for example, a pin contact or other member inserted between the tines thereof to engagement therewith. A planar fork contact would be one that has the tines and preferably, although not necessarily, the base, which holds the tines thereto, all substantially in a single narrow plane, i.e. that plane of the sheet material from which the contact is formed, especially by the noted die cutting. It would be desirable to provide inlay material at the contacting/wiping areas of the tines of such planar fork contacts.

With the foregoing in mind, then, it would be desirable to be able to manufacture planar fork contacts that are substantially uniform, that have contacting material, such as gold inlay or the like, at the contacting areas of one and preferably both of the fork tines, and/or that provide a smooth contacting surface for engagement with pins or other members inserted to engagement with respective contacts even though the contacts are formed by a stamping or die cutting process.

SUMMARY OF THE INVENTION

Briefly, the invention relates to improvements in methods and apparatus for making electrical contacts, especially fork contacts, and further especially such fork contacts that have coplanar tines. Using the method and apparatus of the invention, inlay material, such as gold, palladium-silver or the like, which is applied in one plane, for example to sheet material from which the fork contacts are cut, is used effectively in another plane, i.e. that of the contacting or wiping area of the respective fork tines.

According to the invention, sheet material having such inlay material therein is die cut or stamped to define the fork contacts, and the fork tines are twisted to place the inlay material in substantially opposed confrontation so as to engage a pin contact or like member inserted between the tines. Prior to twisting each of the tines is weakened at a specified area so that during twisting the twist substantially will be limited to such area. Also, prior to twisting a portion of each pair of tines of a given contact is bowed or curved out of the major plane of the contact; and during the twisting each fork is twisted in a relatively opposite direction to bring such curved portions into convex opposed confrontation with each other to define a contacting or wiping area of the contact. The twisting, moreover, causes the very smooth surface of the forked tines, which are first engaged by a cutting die during cutting of the contact from the sheet material, to be exposed as the contacting area; therefore, any burrs or sharp edges that might be created during the die cutting of the contact would be on the back side of the operative tines and would not detrimentally affect operation of the fork contact.

With the foregoing in mind, one aspect of the invention relates to a method of making a fork contact initially having plural tines with respective coplanar surfaces and contacting material integral with such coplanar surface of at least one tine, including twisting such at least one tine to rotate such coplanar surface to place at least a portion of such contacting material in substantially confronting relation with the other tine.

Another aspect relates to a method of making a fork contact, including twisting a pair of tines of such fork contact to place a contacting surface of one tine in opposed confrontation with the contacting surface of another tine.

An additional aspect relates to a method of making a fork contact that has a pair of parallel tines, including twisting at least one of the tines to place a contacting surface thereof in opposed confrontation with the other tine.

A further aspect relates to an apparatus for making a fork contact having plural tines, including a twisting means for twisting at least one of the tines to place a contacting surface thereof in opposed confrontation with the other tine.

Other aspects of the invention include, for example, both independently and in combination with the foregoing, controlling of the twisting, setting of the twisted tines, bowing of the tines prior to twisting, twisting to locate the burr side of each tine away from the contacting area and, accordingly, to present the smooth side of the tine at the contacting area, and use of such contacts to make an electrical connector, such as a cable termination or cable termination assembly.

These and other aspects of the invention will become more apparent as the following description proceeds.

It is, accordingly, a primary object of the invention to manufacture and/or to provide an apparatus for manufacturing electrical contacts that are improved in the noted respects.

Another object is to enable use of inlay material in planar fork contacts.

An additional object is to facilitate use of inlay material in fork contacts, especially of the planar type, and further especially on both prongs or tines thereof.

A further object is to expedite the manufacturing of fork contacts.

Still another object is to maintain uniformity of electrical contacts.

Still an additional object is to confine twisting in the tines of an electrical contact to a specified area.

Still a further object is to allow use in one relative plane of an electrical contact, and especially a fork contact, of inlay material applied to the contact in a different, preferably orthoganol, plane.

Even another object is to obtain a smooth contacting surface in a fork electrical contact that is die cut or stamped.

Even an additional object is to minimize the cost of contacting material applied to electrical contacts, such as inlay material, and especially gold inlay or palladium silver inlay material.

Even a further object is to make a relatively thin or constant thickness dimension electrical contact, especially of the planar fork type, having inlay material in the contacting areas of the fork tines.

Yet another object is to effect twisting and setting of deformable material, and especially to effect the same simultaneously, and further especially to effect the same of the tines of a planar fork contact.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
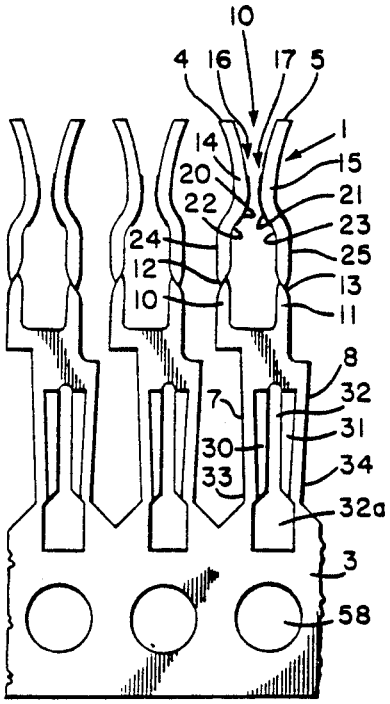
FIG. 1 is a plan view of a plurality of electrical contacts formed using the method and apparatus in accordance with the present invention.

Referring now in detail to the drawings, wherein like reference numerals designate like parts in the several figures, three contacts made in accordance with the method and by the apparatus of the present invention are generally indicated at 1 in FIG. 1. Each of the contacts 1 is attached by a thin connection 2 to a breakaway strip 3 for convenience of manufacturing and manipulation prior to use of the contacts for various electrical connection purposes. Each contact 1 is of the planar fork type having a pair of tines 4, 5 connected by a common base 6 and a pair of terminal legs 7, 8. Each tine has a straight leg portion 10, 11, a twist 12, 13, and a curved leg portion 14, 15. The twists 12, 13 and curved leg portions 14, 15 are such that the latter are positioned opposite each other in a convex relationship and in substantially direct opposing confrontation, as is seen most clearly in FIGS. 1 and 2. Therefore, the contacting, wiping, or connecting (those terms being used interchangeably herein) areas 16, 17 of the tines 4, 5 also are positioned in relatively opposed direct confrontation with each other so as to connect with a member, such as a pin contact, a printed conductor on a printed circuit board, or the like, as such member is inserted into the space 18 between the tines 4, 5.

Contacting material 20, 21, such as gold, palladium silver, or the like, is in each tine 4, 5 at the contacting area 16, 17 thereof. The contacting material preferably is hard, is of good electrical conductivity (preferably better electrical conductivity than that of the material of which the tines 4, 5 as a whole are made), and is smooth so as to provide a substantially continuously smooth surface of the respective tines intended to engage a member inserted therebetween. Each tine 4, 5 has a smooth surface 22, 23 and a burr surface 24, 25, and the twists 12, 13 are in opposite directions and about 90° of turning. As a result, the smooth surfaces 22, 23 appear facing up out of the plane of the paper in FIG. 1 at the contact area below the twists 12, 13 and face in confronting relation to each other above the respective twists for presenting a smooth surface to a member inserted between the respective tines 4, 5. The burr surfaces 24, 25 are not seen in the tines 4, 5 beneath the twists 12, 13, for they are at the underside of the contacts as is illustrated in FIG. 1; however, the burr surfaces are seen at the outsides of the respective tines above the respective twists so that in the contacting areas 16, 17 and at the space 18 the burr surfaces would not be exposed to the member inserted into the contact 1.

The tines 4, 5 preferably are resilient, being capable of separating in response to force of a member inserted into the space 18, as such member may be guided by the curvature of the curved leg portions 14, 15 into engagement with the respective contacting areas 16, 17. The twists 12, 13 preferably are located at approximately the same location on each tine so that the resilient deformation of each tine of a given contact and of those of each of the contacts will be substantially the same.

Figure 7:
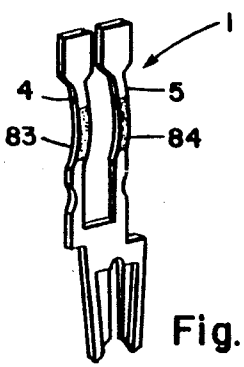
FIG. 7 is a three-quarters isometric view of a planar fork contact in an intermediate stage of manufacturing thereof having a curved section in each of the fork tines.

Extending down from each base 6 are the terminal legs 7, 8, each of which includes a coined relatively sharp surface/edge portion 30, 31, which form opposite boundaries of a linear slot 32 therebetween. Pointed tips 33, 34 at the end of the legs 7, 8 remote from the base 6 are formed when the thin connection 2 between the contacts 1 and the break-away strip 3 is actually broken, as can be seen, for example, in FIG. 7.

The contacts 1 are described in greater detail in commonly assigned, concurrently filed U.S. Pat. application Ser. No. 309,567 for "Planar Fork Contact With Gold Inlay Material" and the entire disclosure of such application hereby is incorporated by reference.

Figure 2:
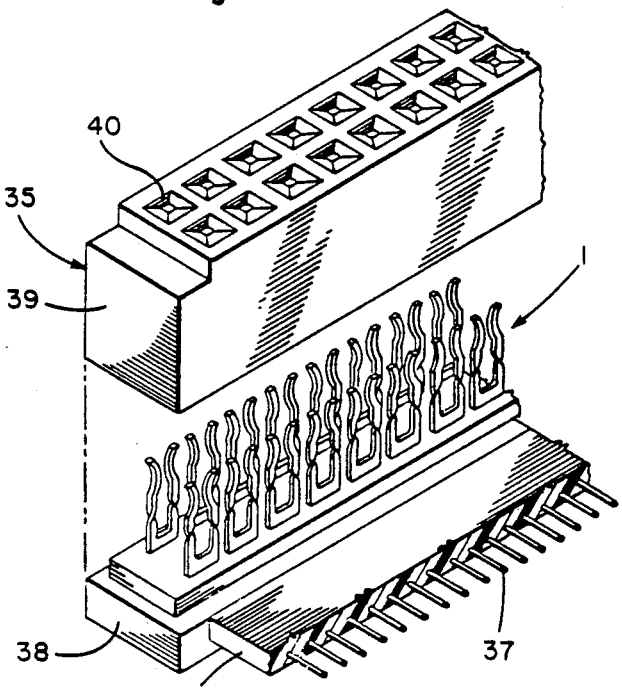
FIG. 2 is an exploded isometric view of a cable termination assembly type of connector made in accordance with the present invention using the contacts thereof.

Turning briefly to FIG. 2, the electrical contacts 1 may be employed in the manner illustrated as part of an electrical connector, namely the illustrated cable termination assembly 35. Such cable termination assembly includes an electrical cable 36; the contacts 1, the terminal legs 7, 8 of which pierce through the cable insulation to engage respective conductors 37, which enter the slots 32 and engage securely with the surface/edge portions 30, 31; a body 38 of electrically nonconductive material molded about parts of the contacts 1 and cable 36 to form an integral structure; and a cover 39. A similar cable termination assembly is disclosed in commonly assigned U.S. Pat. No. 4,030,799, the entire disclosure of which hereby is incorporated by reference. Briefly, though, it will be appreciated that the electrical contacts 1 complete respective electrical connections with the conductors 37. The tines 4, 5 of the respective contacts extend into compartments in the cover 39, and pins or other members may be inserted through openings 40 in the cover to make electrical connection with respective tines of individual contacts 1. It will be appreciated that other types of electrically conductive members may be inserted to engage with the respective contacts, such as printed circuit boards, which have thereon respective printed circuit traces, and the like, in which cases it may be desirable to modify the configuration of the cover 39 for appropriate guidance of the respective members to engagement with respective contacts 1.

Figure 3:
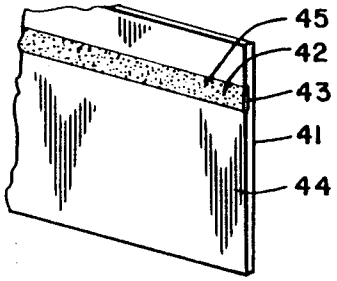
FIG. 3 is a three-quarters isometric view of sheet material with gold inlay material therein and from which electrical contacts may be die cut in accordance with the present invention.

Referring now to FIG. 3, a sheet 41 of relatively thin electrically conductive, e.g. metal, such as nickel silver, material from which the contacts 1 are cut contains a thin ribbon strip 42 of contacting material, such as gold, palladium-silver or like inlay material. A thickness of the material may be on the order of several, say about twenty, millionths of an inch to on the order of about fifty millionths of an inch in thickness; and preferably the inlay material is about thirty millionths of an inch thick. The contacting or inlay material 42 may be press fit into a shallow groove 43 in the surface 44 of the sheet 41 such that the surface 45 of the inlay material itself is substantially continuous and integral with the surface 44. The technique for inlaying the material 42 may be a conventional one and usually would be expected to include the application of a pressure or force, such as a force applied by a roller that rolls relative to the surfaces 44, 45. As a result of such rolling, the surfaces 44, 45 will be quite smooth so as to provide excellent contacting areas 16, 17 of the contacts 1. Preferably the contacting material 42 is harder, denser, and more highly electrically conductive than the material of which the sheet 41 is formed so that the effectiveness of an electrical contact cut from such sheet is improved over a contact without such contacting material therein.

Figure 4:
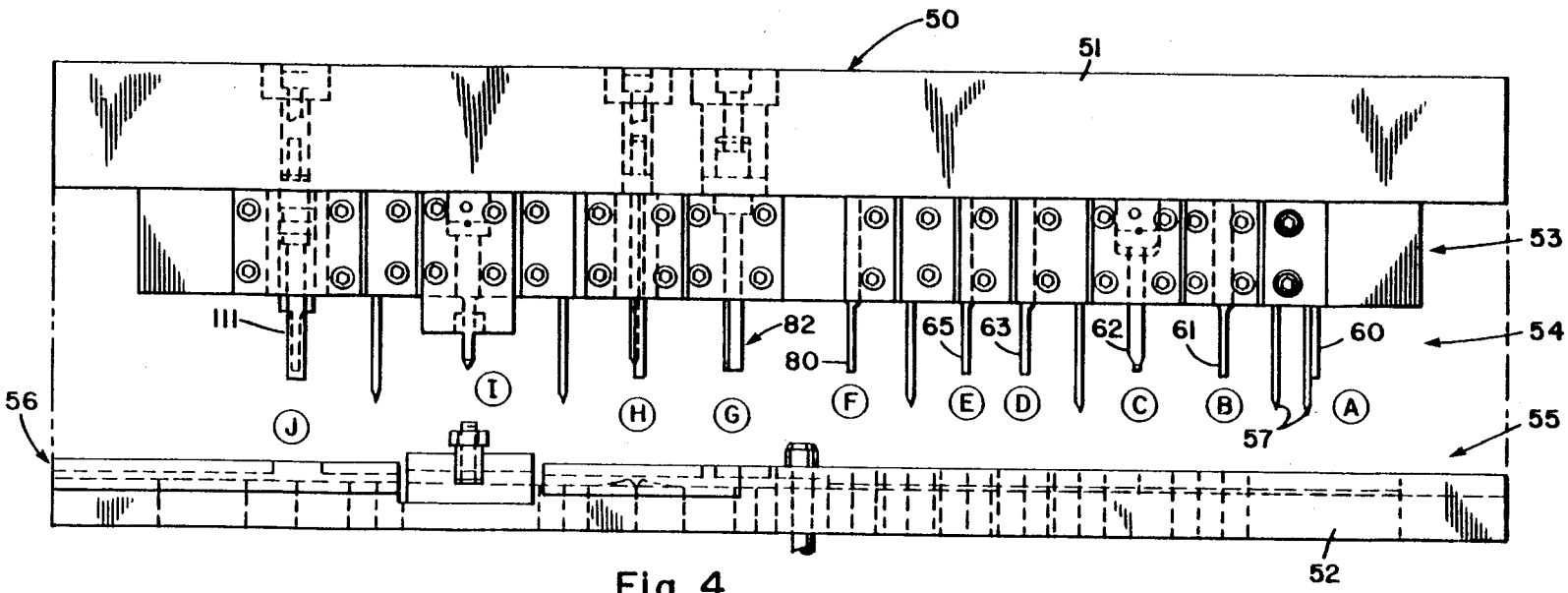
FIG. 4 is a side elevation view of an apparatus in accordance with the present invention for making planar fork contacts with inlay material.

Turning now to FIG. 4, an apparatus or machine 50 in accordance with the present invention for making the contacts 1 from the sheet material 41 is illustrated. The apparatus 50 has several stations through which a strip of the sheet material 41 passes in order to form a number of the contacts 1 mounted on a break-away strip 3 in the manner illustrated in FIG. 1. Those stations include the following: A. pilot hole cutting station; B. insulation displacement slot (IDS) cutting station; C. IDS coining station; D. window cutting station; E. fork punch station; F. separating punch station; G. curve forming station; H. first twisting station; I. twisting and setting station; and J. tab cut-off station.

Figure 5:
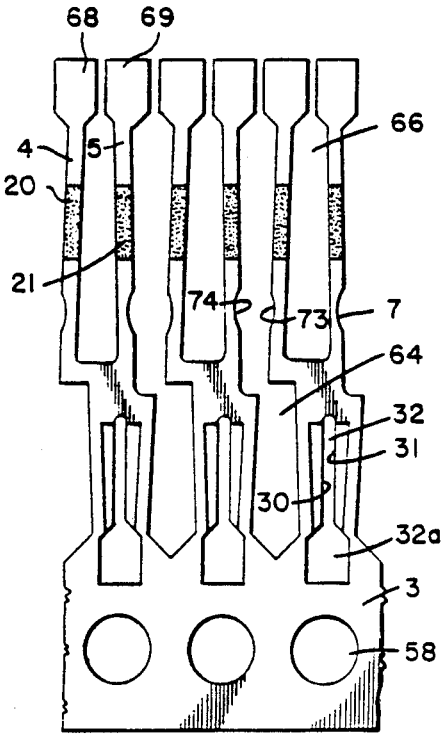
FIG. 5 is a plan view of a plurality of electrical contacts in an intermediate stage of formation to the finished form shown in FIG. 1, such contacts being made using the machine of FIG. 4.

The apparatus 50 includes a pair of relatively movable upper and lower bases 51, 52. Conventional mounting devices generally indicated at 53 are provided for mounting respective tools generally indicated at 54 on the upper base 51 in alignment with corresponding openings, surfaces and the like associated with the lower base 52, as is standard practice in conventional die cutting or stamping equipment. Ordinarily a strip of sheet material 41 is fed into the inlet side 55 of the apparatus 50 and is pulled therethrough by conventional indexing means, not shown, as the various operations of the several stations A-J are carried out on the strip to form the contacts 1. As the strip leaves the exit end 56 of the apparatus 50, it will appear as the contacts 1 and break-away strip 3 shown in FIG. 1. Index alignment pins 57 cooperate with pilot holes 58 (FIG. 1) in the break-away strip 3 to assure correct alignment of the sheet 41 as it passes through the apparatus 50 and is cut and formed by the various tools 54 at the several stations A-J. The various portions of the contact referred to as being cut by the apparatus 4 are shown in FIGS. 1 and 5.

At the pilot hole cutting station A, which is the first station through which the sheet 41 is indexed through the apparatus 50, a pilot hole cutting punch 60 is moved into engagement with the sheet 41 in the area where the break-away strip 3 is to be, and such punch sequentially cuts each of the pilot holes 58. As was noted above, the index alignment pins 57 cooperate with such pilot holes 58 to assure proper alignment of the sheet 41 with the respective tools 54 at the respective stations A-J.

At the insulation displacement slot cutting station B a punch 61 configured approximately in the shape of the slot 32 (FIG. 1), but having slightly wider width than the spacing between the edges 30, 31 of FIG. 1, cuts the slot 32 and the extension 32*a* thereof down into the area of the break-away strip 3. The width of the punch 61 in the area where it would cut the slot 32 is greater than the final width of the slot 32 because material along the boundaries of such slot is coined by coining tool 62 at the insulation displacement slot coining station C, whereby material along such slot is swaged effectively sharpening the same to facilitate cutting through the insulation 36 and secure biting into the conductors 37 (FIG. 2).

At the window cutting station D a window cutting punch 63 cuts a window 64 between what will be respectively adjacent contacts 1. Such window would extend from the break-away strip 3 along the outer edges of respectively adjacent terminals legs 7, 8 of adjacent contacts, to the areas of the bases 6 of such contacts.

Figure 6:
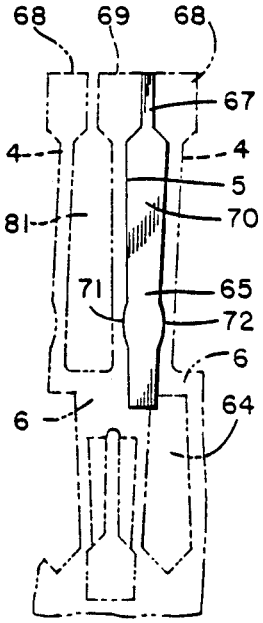
FIG. 6 is a section view of a fork separating punch used in the machine of FIG. 4.

The fork punch 65 cuts open the area 66 between the adjacent tines 4, 5 of respectively adjacent contacts 1. A top plan view of the fork punch 65 is shown in FIG. 6 in relation to the tines 4, 5 of adjacent contacts 1. The fork punch has a narrow portion 67 for cutting a narrow strip of material between flags or tabs 68, 69 at the remote ends of the tines 4, 5 relative to the respective bases 6 of the contacts. The fork punch 65 also has a relatively wide portion 70 for cutting the material from the area 66 all the way down to meet with the window 64. Importantly, the fork punch 65 includes a pair of curved bulges 71, 72 in the wide portion 70 thereof for cutting respective cutouts 73, 74 (FIG. 5) in the tines 4, 5. The cut-outs 71, 72 provide relatively thinner cross-sectional area portions for the respective tines 4, 5, relative to the otherwise generally uniform cross-section or thickness of the major extent thereof, and the purpose of such cut-outs is to weaken the tines 4, 5 at the area of such cut-outs. As a result, when the twisting occurs, as will be described further below, such twisting will be substantially uniform in each tine and confined approximately to the area of the respective weakening cut-outs 73, 74.

The relatively wide portion 70 of the fork punch 65 itself has a slight taper in cross-section, as can be seen in FIG. 6 from wider near the narrow portion 67 to narrower at the portion beyond the bulges 71, 72. Such taper corresponds with a similar, but opposite tapering of the separating punch 80 at the separating punch station F. More specifically, such separating punch 80 cuts the material from the area 81 between the adjacent tines 4, 5 and tabs 68, 69 of a single contact 1, as can be seen most clearly in FIG. 6. Due to the opposite and cooperating tapers of the separating punch 80 and fork punch 65, the major linear extents of the respective tines 4, 5 will have constant cross-sections and will be linear, as is seen in FIG. 6. The spacing between the tines 4, 5 of a single contact 1, though, will be slightly wider near the base 6 than at the remote ends of the tines relative to the base. Such taper helps to provide the desired final form of the contacts with their respective twists 12, 13, as is seen in FIG. 1. The uniform thickness of the tines 4, 5 over the linear extent thereof, except at the cut-outs 71, 72, helps to assure that the twists will be confined to the areas of such cut-outs and that the resilient forces of the tines during operation of respective contacts 1 will be substantially uniform.

Each of the punches 61, 63, 65, and 80 first strikes the smooth surface 44 of the sheet 41 during any punching operation. As a result, the smoothness of the surface 44 is not affected by the punching operation. However, the back side (not shown) of the sheet 41 in FIG. 3 may have burrs, sharp edges, or the like formed thereon as the respective punch passes through the sheet. An important feature of the present invention is the ability to utilize the smooth surface 44 for the contacting areas 16, 17 of the tines 4, 5 for optimum contact engagement with a member inserted therebetween and for avoiding damage to such an inserted member.

Figure 8:
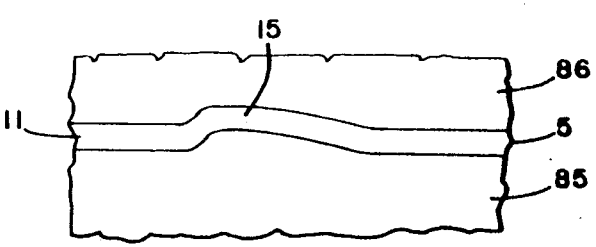
FIG. 8 is an enlarged schematic end elevation view of a stamping die of the apparatus of FIG. 4 for making such curved portions in the fork tines of the contact of FIG. 7.

Turning now to the curve forming station G, a die 82, which is schematically illustrated in FIG. 8, deforms the tines 4, 5 at or near the remote ends thereof relative to the base 6 in effect to form bows 83, 84 (FIG. 7) which will become the curved leg portions 14, 15. the die 82 is formed by male and female portions 85, 86 between which the respective tines, such as the tine 5 shown in FIG. 8, are pressed to form the respective curves or bows therein. As is seen in FIG. 8, the curved leg portion 15 and the straight leg portion 11 of a tine 5 from a single contact 1 is being formed by the die 82.

Figure 9:
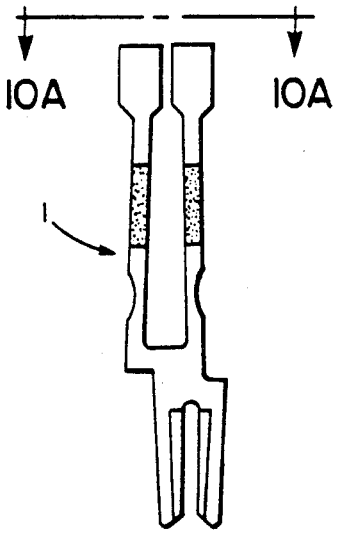
FIG. 9 is a plan view of a contact made using the apparatus of FIG. 4.
Figure 10A:
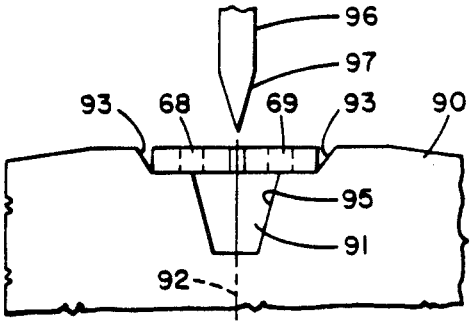
FIGS. 10A and 10B are enlarged schematic views of a first twisting station and operation thereof in the apparatus of FIG. 4 looking generally in the direction of the arrows 10A—10A of FIG. 9 to orient the electric contact being so twisted.
Figure 10B:
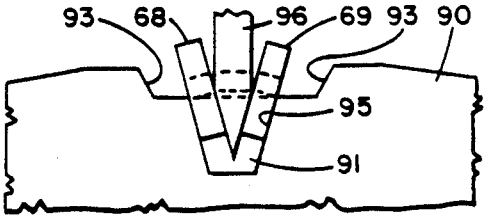

The tines 4, 5 now are twisted at the first twist station H and the final twisting and setting station I. In FIG. 9 a plan view of the contact 1, less the break-away strip 3, which now serves as the medium for carrying the contact through the rest of the apparatus 50, is shown upon entering the first twist station H, which is schematically shown in operation in FIGS. 10A and 10B. The die 90 at the first twist station H has a tapered and stepped cavity 91 therein, the tapering being relative to a centerline 92 and comprising upper tapered walls 93 separated by a step 94 from lower tapered walls 95. A punch 96 has a tapered point 97, which corresponds angularly in parallel with the lower tapered cavity walls 95. The upper portion of the cavity 91 bounded by the upper tapered walls 93 receives the tabs 68, 69, the tapering of the walls 93 guiding the tabs into position in the cavity 91. When the punch 96 is moved downward relative to the illustration in FIG. 10A the force applied to the tabs 68, 69 causes the respective tines 4, 5 to twist about axes parallel to the respective tines such that the tabs become rotated to the orientation shown in FIG.

10B with the tines 4, 5 being similarly rotated proximate the tabs causing the desired twisting at the cut-outs 71, 72 where the twisting forces will be concentrated. The step 94 preferably extends the length of the cavity 91 so that the entire contact 1 can fit in such cavity between the upper tapered walls 93 and so that after the twisting has occurred at least part of the respective tines will remain supported by the step.

Figure 11:
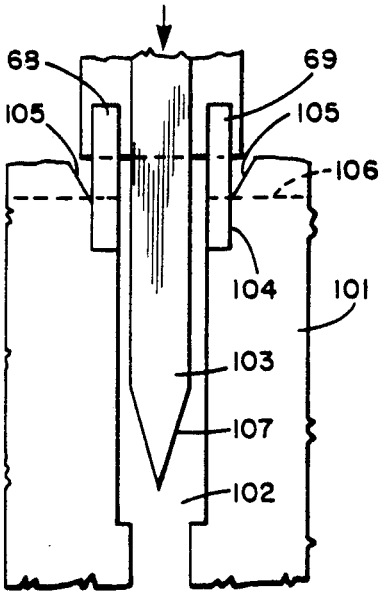
FIG. 11 is an enlarged schematic illustration of the final twist and set station of the apparatus of FIG. 4.
Figure 12A:
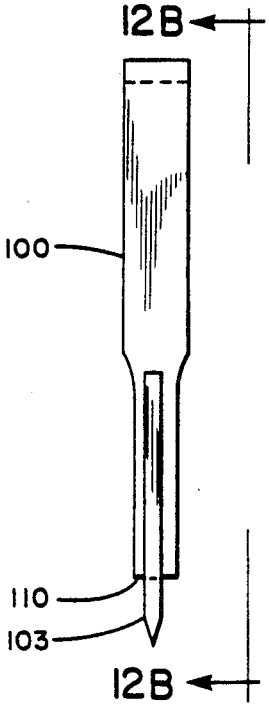
FIGS. 12A and 12B are, respectively, front and side views of the punch for the final twist and set station of FIG. 11.
Figure 12B:
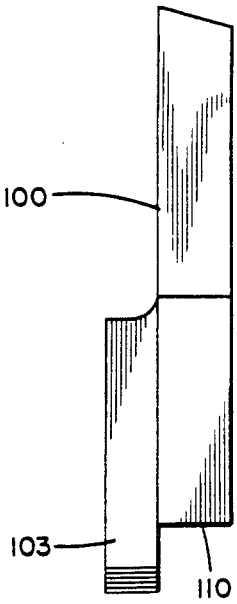

After the preliminary twisting has occurred at the first twist station H, the final twisting is effected at the final twisting and setting station I. Moreover, at such station the tendency of the tines 4, 5 to untwist is overcome by applying a final set to the tines in order to hold the twists 12, 13 relatively permanently. The final twisting and setting station I is illustrated schematically in FIG. 11, and the punch 100 used at such station is shown in FIGS. 12A and 12B. Specifically, the station I includes a die 101 that has an internal cavity 102 for receiving the tip 103 of the punch 100. The upper end of the cavity 102 has a squarely stepped wall portion 104, and a tapered wall portion 105. The slope of the wall portion 105 is approximately the same or slightly less than that of the lower tapered wall 95 of the die 90 (FIG. 10A), and such slope is intended to receive the tabs 68, 69 as they have been rotated at the first twist station H. A shelf behind the plane of the drawing of FIG. 11 provides a continued support for the tines 4, 5 as the tabs 68, 69 fit into the upper portion of the cavity 102. After the contact I has been so placed with the tines 4, 5 on the shelf 106 and the flags 68, 69 lying approximately parallel to the tapered walls 105, the punch 100 is moved from a position above the contact I and die 101 to a position bringing the tip 103 into the cavity 102 in the manner shown in FIG. 11. The tip 103, which is also seen in FIGS. 12A and 12B applies force to the tabs 68, 69 further forcing them into the relative parallel position shown in FIG. 11. The point 107 of the tip 103 is tapered approximately the same as the point 97 of the punch 96 (FIG. 10A) so that the final rotating of the tabs 68, 69 will be a relatively smooth process.

With the tabs 68, 69 forced to the position shown in FIG. 11 by the punch tip 103, the setting surface 110 of the punch 100 applies to the tines 4, 5 at the area of the twists 12, 13 a force that is adequate to deform the tine material at the twists beyond the elastic limit of such material, thereby causing the twists to take a substantially permanent set. As a result of such a set, the tines will not untwist when the punch 100 is withdrawn from the contact.

With the tines so twisted, the curved leg portions 14, 15, which now have been rotated 90° in respectively opposite directions, become aligned in substantially directly opposed confrontation with each other with a convex-to-convex relation of the respective curved leg portions 14, 15. The contacting material 20, 21, then, at such curved leg portions is in position to wipe against and to contact with a member inserted into the space 18 between the tines (FIG. 1). Also, the burr surfaces 24, 25 of the respective tines will be at the effective back sides of the tines relative to the smooth front sides thereof that engage the inserted member.

The two separate twist stations H and I are preferred, among other reasons, to obtain a relative maximum amount of twisting of the tines in a controlled manner, i.e. defining the area of the twist or confining the twists to the area of the cut-outs 73, 74 without damaging the material of which the tines 4, 5 are formed. The use of such multiple stations to provide the desired twisting also facilitates providing appropriate supports for the remainder of the contacts that require such support during the twisting and/or during the setting functions.

The tabs 68, 69 are cut off from the respective tines at the tab cut-off station J of the apparatus 50. To effect such cutting, there is a punch 111 coupled by a mounting device 53 to the upper base 51, and a corresponding support to accommodate the contact 1 beneath the punch 111 is located on the lower base 52 providing support for the contact as the punch 111 cuts off the tabs.

The thusly formed contacts will proceed to be discharged from the apparatus 50 via the exit end 56 in the form of the contacts 1 connected to a break-away strip 3 ready for use to make the connector 35 or for other use for electrical contacts.

The method of the invention, then, may be summarized, as follows. Into a strip of sheet material contacting material is provided. Such contacting material may be inlay material, preferably of gold, palladium silver or the like. The strip of sheet material is inserted into the apparatus 50, oriented so that the inlay material 42 faces toward the respective punches to maintain the smooth continuity of the surface 44 when the final contact has been completed and to assure that the burr sides of the contacts will be away from the contacting areas of the tines 4, 5. Moreover, the sheet 41 is oriented such that the contacting material 42 will be in a place from which the respective curved leg portions and, thus, contacting areas of the respective tines will be formed.

The insulation displacement slot 32 is cut and then is coined. Thereafter, the window 64 between adjacent contacts is cut, followed by cutting of the outsides of the respective forks or tines, including the cut-outs 71, 72. The area 81 is cut out to separate the tines of a given contact. Bows or curves are formed in the tines of each contact, and then initial twisting of the respective tines occurs by applying force to the respective tabs 68, 69. The final twisting is performed and the respective twists are set substantially permanently by the application of adequate force for that purpose. Finally, the tabs 68, 69 are cut off and the contacts 1 are ready for use by breaking the same away from the break-away strip 3 at the thin connection 2 therebetween.

STATEMENT OF INDUSTRIAL APPLICATION

From the foregoing, it will be appreciated that the method and apparatus of the present invention enables the facile manufacturing of planar fork contacts with inlay material therein,with effective use of a minimum amount of contacting material therein, with the smooth rolled surface of the contact material being exposed at the contacting area and the burr surface remote from the latter, and the like. The contacts then may be used in various electrical connectors.

We claim:

1. A method of making a planar fork contact which method includes the twisting of contact tines, comprising the following steps:

die cutting a strip of a first material with a axially extending inlay of a second contacting material integral therewith to form parallel pairs of elongated tines with respective coplanar surfaces and the contacting material integral with such respective coplanar surfaces, forming a convex section in each tine so that the tine is convex out of the major plane of the contact at a portion thereof that includes such contacting material, whereby each tine has a contacting area including contacting material at such convex section, reducing the width in each of the tines at a predetermined location remote from the connecting material to provide a weakened area operative to confine the area of twist to such predetermined location, and after performing said die cutting, forming and width-reducing steps, twisting adjacent tines of at least one pair thereof in opposite directions at said predetermined location to rotate such coplanar surfaces to place such convex sections back into the major plane of the contact in convex confronting relation with each other and to place such contacting areas in substantially confronting relation with each other.

2. The method of claim 1, further comprising setting such twisted tine by applying a force to such tines that deforms the material thereof beyond the elastic limit at the area twisted.

3. The method of claims 1 or 2, wherein such contacting material comprises inlay material selected from a group comprising gold or palladium-silver.

4. The method of claims 1 or 2, said width-reducing comprising confining the areas of twisted material to a predetermined area of such tines by cutting areas of reduced cross-section in such tines, each tine having a generally linear axis and said twisting comprising twisting each of such tines about such axis thereof.

5. The method of claims 1 or 2, said twisting comprising preliminarily twisting such tines an amount less than the full twist of the final contact, and subsequently further twisting such tines to complete the twisting thereof.

6. The method of claims 1, 2 or 4, further comprising cutting such tines and a base as an integral structure from sheet material, such cutting including cutting a tab as an integral part of each tine, said twisting comprising applying a force to such tabs to twist such tines at said predetermined location, and further comprising cutting off such tabs after twisting has been accomplished.

7. The method of claim 1, wherein said steps of die cutting and width-reducing are carried out with a single punch.

8. The method of claim 1, wherein said steps of die cutting and width-reducing are carried out simultaneously.

9. A method of making a planar fork contact which method includes the twisting of contact tines, comprising the following steps:

die cutting a strip of a first material with an axially extending inlay of a second contacting material integral therewith to form parallel pairs of elongated tines with respective coplanar surfaces and the contacting material integral with such respective coplanar surfaces, forming a convex section in each tine so that the tine is convex out of the major plane of the contact at a portion thereof that includes such contacting material, whereby each tine has a contacting area including contacting material at such convex section, defining in the tines a predetermined location of twist, and after performing said die cutting, forming and defining steps, twisting adjacent tines of at least one pair thereof in opposite directions at said predetermined location to rotate such coplanar surfaces to place such convex sections back into the major plane of the contact in convex confronting relatin with each other and to place such contacting areas in substantially confronting relation with each other, said die cutting including sequentially cutting from the strip of material a plurality of such contacts including tines, a base and terminal legs for each contact while such contacts remain connected to a common holding strip of such strip of material, said cutting including cutting such tines such that such contacting material is located at the contacting area of such tines, and said twisting including simulaneously twisting said tines at said predetermined location of a respective contact while such contact remains connected to such holding strip.

10. A method of making a planar fork contact which method includes the twisting of contact tines, comprising the following steps:

die cutting a strip of a first material with an axially extending inlay of a second contacting material integral therewith to form parallel pairs of elongated tines with respective coplanar surfaces and the contacting material integral with such respective coplanar surfaces, forming a convex section in each tine so that the tine is convex out of the major plane of the contact at a portion thereof that includes such contacting material, whereby each tine has a contacting area including contacting material at such convex section, reducing the width in each of the tines at a predetermined location, after performing said die cutting, forming and width-reducing steps, twisting adjacent tines of at least one pair thereof in opposite directions of said predetermined location to rotate such coplanar surfaces to place such convex sections back into the major plane of the contact in convex confronting relation with each other and to place such contacting areas in substantially confronting relation with each other, and setting such twisted tines by applying a force to each tine at the predetermined location that deforms the material thereof beyond the elastic limit at the predetermined location, said die cutting including sequentially cutting from the strip of material a plurality of such contacts including tines, a base and terminal legs for each contact while such contacts remain connected to a common holding strip of such strip of material, said cutting including cutting such tines such that such contacting material is located at the projected contacting area of such tines, and said twisting including simultaneously twisting said tines at said predetermined location of a respective contact while such contact remains connected to such holding strip.

11. A method of making a planar fork contact which method includes the twisting of contact tines, comprising the following steps:

die cutting a strip of a first material with an axially extending inlay of a second contacting material integral therewith to form parallel pairs of elongated tines with respective coplanar surfaces and the contacting material integral with such respective coplanar surfaces, forming a convex section in each tine so that the tine is convex out of the major plane of the contact at a portion thereof that includes such contacting material, whereby each tine has a contacting area including contacting material at such convex section, defining in the tines a predetermined location of twist, and after performing said die cutting, forming and defining steps, twisting adjacent tines of at least one pair thereof in opposite directions to rotate such coplanar surfaces to place such convex sections back into the major plane of the contact in convex confronting relation with each other and to place such contacting areas in substantially confronting relation with each other, said die cutting including sequentially cutting from the strip of material a plurality of such contacts including tines, a base and terminal legs for each contact while such contacts remain connected to a common holding strip of such strip of material, said cutting including cutting a tab with said tab being an integral part of each tine, and cutting such tines such that such contacting material is located at the contacting area of such tines, and said twisting including simultaneously applying a force to each tab to twist each tine of a respective contact while such contact remains connected to such holding strip, and further comprising cutting off each tab after twisting has been accomplished.

12. An apparatus for making planar fork contacts including upper and lower relatively reciprocatable bases having a plurality of stations connected with said bases for forming the contacts therebetween, comprising means operatively associated with said apparatus for indexing a strip of material having an axially extending inlay of a second contacting material integral therewith successively along a path through said stations, one of said stations having cutting means connected with said bases for die cutting the strip to form parallel pairs of elongated tines with respective coplanar surfaces and the contacting material integral therewith, a second of said stations having forming means connected to at least one of the bases for forming a convex section in each tine so that the tine is convex about an axis parallel to the axis of the inlay and out of the major plane of the contact at a portion thereof that includes such contacting material whereby each tine has a contacting area including contacting material at such convex section, means connected to at least one of the bases located along the strip path through said stations physically operative upon each of the tines to reduce the width in each of the tines at a predetermined location remote from the inlay therein thus providing a weakened area operative to confine an area of twist to such predetermined location, and a third of said stations, subsequent to said means to define and said one and second of said stations, having twisting means connected to at least one of the bases for twisting adjacent tines of at least one pair thereof in opposite directions to rotate such coplanar surfaces of each tine and to place such convex sections back into the major plane of the contact in convex confronting relation with each other and to place such contacting areas in substantial confronting relation with each other.

13. The apparatus of claim 12, said twisting means comprising means for simultaneously twisting such tines, and further comprising setting means connected to at least of the bases for setting the twist in such tines to resist untwisting thereof.

14. The apparatus of claim 12, each tine having a generaly linear axis, and said forming means comprising means for forming such convex section as a smoothly curved bow curved about a single axis which is generally perpendicular to the major axis of the respective tine.

15. The apparatus of claim 13, each of such tines having a generally linear axis, said twisting means comprising means for twisting such tine about such respective axes, and said setting means comprising means for applying to such tines force in a direction generally perpendicularly with respect to such axes that deforms the tines beyond the elastic limit of the material thereof at the area of the twist therein.

16. The apparatus of claims 12 or 15, said twisting means comprising preliminary twist means for twisting such tines an amount less than the full twist of the final contact, and further twisting means connected to at least one of the bases for twisting such tines to complete the twisting thereof.

17. The apparatus of claim 12, said cutting means comprising means for cutting such tines and a base of a fork contact from such strip material, said cutting means comprising means for cutting such tines to form the same with generally parallel, linear uniform cross-section, and said width reducing mans comprising means for cutting a cut-out area or reduced cross-section in each tine to control the twisting therein.

18. The apparatus of claim 17, said cutting means further comprising means for cutting such tnes with enlarged tabs at ends thereof remote from such base, said twisting means comprising means for applying force to such tabs to twist such tines, and further comprising cut-off means for cutting off such tabs after twisting thereof.

19. The apparatus of claim 12, said twisting means comprising a main surface, a cavity in said main surface, a support platform at plural sides of said cavity, guide means for guiding tines of such contact to respective support platforms, and punch-like means connected to at least on of the bases insertable in said cavity for applying force to twist such tines, and said setting means comprising a tool surface coupled to and at least partly movable with said punch-like means for applying to such tines force that deforms the same beyond the elastic limit of the material thereof at the area of the twist therein.

20. The apparatus of claim 12, further comprising cutting means connected to at least one of the bases for cutting terminal legs and a slot therebetween for each contact, and coining means connected to at least one of the bases for coining edges of such terminal legs to provide relatively sharp edges adjacent such slot.

21. The apparatus of claim 12, wherein said cutting means and said means for defining comprise a punch.

* * * * *